US007773103B2

(12) United States Patent
Takeda

(10) Patent No.: US 7,773,103 B2
(45) Date of Patent: Aug. 10, 2010

(54) LIGHT SOURCE CONTROL DEVICE AND METHOD FOR A DISPLAY APPARATUS USING PULSE WIDTH MODULATION

(75) Inventor: Takashi Takeda, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 977 days.

(21) Appl. No.: 11/188,802

(22) Filed: Jul. 26, 2005

(65) Prior Publication Data

US 2006/0114271 A1 Jun. 1, 2006

(30) Foreign Application Priority Data

Nov. 8, 2004 (JP) ..... 2004-323224

(51) Int. Cl.
*G09G 5/10* (2006.01)

(52) U.S. Cl. ..... 345/690; 345/691; 345/692

(58) Field of Classification Search ..... 345/691, 345/690, 692

See application file for complete search history.

(56) References Cited

U.S. PATENT DOCUMENTS 4,021,607 A * 5/1977 Amano ..... 348/800
4,634,956 A * 1/1987 Davis et al. ..... 323/222
5,144,631 A 9/1992 Okino
6,091,387 A * 7/2000 Ueno et al. ..... 345/89
6,215,466 B1 * 4/2001 Yamazaki et al. ..... 345/89
6,945,652 B2 9/2005 Sakata et al.
7,009,627 B2 * 3/2006 Abe et al. ..... 345/690
7,253,811 B2 * 8/2007 Tretter et al. ..... 345/204
2003/0063108 A1 * 4/2003 Isono et al. ..... 345/690

FOREIGN PATENT DOCUMENTS

JP 2002-055296 A 2/2002
JP 2003-21800 A 1/2003

* cited by examiner

*Primary Examiner*—Amare Mengistu
*Assistant Examiner*—Gene W Lee
(74) *Attorney, Agent, or Firm*—Oliff & Berridge, PLC

(57) ABSTRACT

Aspects of the invention can provide a light source control device that controls driving for a light source unit in order to supply light that is modulated in response to an image signal. The light source control device can include an amplitude converting unit that allocates at least one bit of the image signal to conversion of an amplitude of a pulse signal and converts the amplitude of the pulse signal according to an allocated number of bits, and a pulse signal generating unit that generates a pulse signal at the amplitude converted in the amplitude converting unit.

8 Claims, 8 Drawing Sheets

FIG. 6A
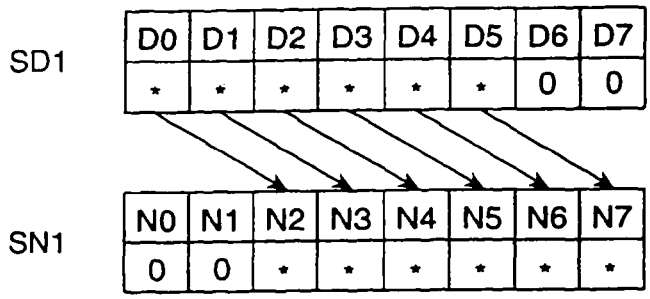
FIG. 6B
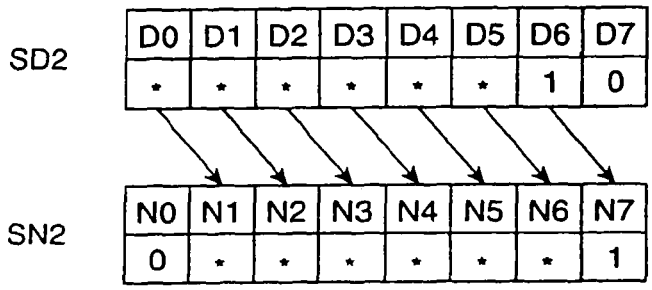
FIG. 6C
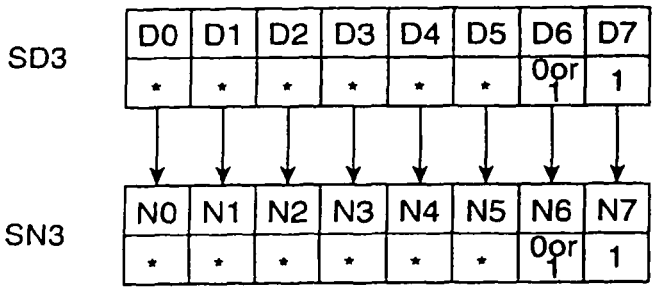
FIG. 6

LIGHT SOURCE CONTROL DEVICE AND METHOD FOR A DISPLAY APPARATUS USING PULSE WIDTH MODULATION

This application claims the benefit of Japanese Patent Application No. 2004-323224, filed Nov. 8, 2004. The entire disclosure of the prior application is hereby incorporated by reference herein in its entirety.

BACKGROUND

Aspects of the invention can relate to a light source control device, a light source control method, and an image display apparatus, and in particular to a light source control device that controls a light source unit of an image display apparatus.

There has been proposed related art image display apparatus that display an image by performing a scanning operation using laser beams. As the image display apparatus using laser beams, there is a front projector and a rear projector. Laser beams, characterized by high monochromaticity and high directivity, are suitable for obtaining images that are bright and have high color reproducibility. Such a related art technique for displaying an image by performing a scanning operation using laser beams is proposed in, for example, Japanese Patent Application Publication No. 2002-55296.

Pulse width modulation ("PWM") for changing a pulse width, at which laser beams are lighted, in response to an image signal can be used for modulation of laser beams. In order to represent gradations corresponding to image signals for all pixels in one frame of an image, it is necessary to set a minimum unit of a pulse to an extremely small width. As the number of pixels of the image is increased and as the number of gradation of the image is increased, the width of the minimum unit of a pulse is further reduced. It is extremely difficult to switch a high-power laser beam source accurately and at high speed according to a pulse of a small width. Therefore, in the related art technique, it may be difficult to display an image with high resolution and an image with a larger number of gradations using accurate gradations.

SUMMARY

An aspect of the invention is to provide a light source control device and a light source control method for displaying an image with high resolution and an image with a large number of gradations using accurate gradations easily and an image display apparatus using the light source control device. According to an aspect of the invention, it is possible to provide a light source control device that controls driving for a light source unit in order to supply light that is modulated in response to an image signal. The light source control device can include an amplitude converting unit that allocates at least one bit of the image signal to conversion of an amplitude of a pulse signal and converts the amplitude of the pulse signal according to an allocated number of bits, and a pulse signal generating unit that generates a pulse signal at the amplitude converted in the amplitude converting unit.

In the invention, a pulse width can be changed in the same manner as the PWM in the related art. In addition, gradation representation can be performed by changing an amplitude of a pulse signal. For example, when gradation representation of eight bits is performed, if high order two bits of an image signal are allocated to the conversion of an amplitude of a pulse signal, the amplitude of the pulse signal is converted in two bits. Considering that strength of light, which eyes of an observer feel, is a product of intensity of the light and a lighting time of the light, it is possible to set the pulse width four times as large as that in the prior art by converting the amplitude of the pulse signal into an amplitude that is one quarter of the amplitude in the prior art. In this way, it is possible to change a width of one bit according to a range of the high order two bits. In particular, it is possible to drive a laser beam source, for which it is difficult to perform high-speed switching, accurately in response to an image signal by increasing a width of one bit in a small gradation. Consequently, a light source control device for displaying an image with high resolution and an image with a large number of gradations using accurate gradations and easily is obtained.

According to another aspect of the invention, it is possible to provide a light source control device that controls driving for a light source unit in order to supply light that is modulated in response to an image signal. The light source control device can include a base current converting unit that allocates at least one bit of the image signal to conversion of a current value of a base current and converts the current value of the base current according to an allocated number of bits, and a pulse signal generating unit that generates a pulse signal with the base current of the current value converted in the base current converting unit as a reference.

In the invention, other than changing a pulse width in the same manner as the PWM in the prior art, gradation representation can be performed by changing a current value of a base current. For example, when gradation representation of eight bits is performed, if high order two bits of an image signal are allocated to the conversion of the base current, the base current is converted in two bits. Other than an original current value of the base current, the base current is set to current values that are one quarter, one half, and three quarter of an original current amplitude. For example, gradation representation for 0 to 64 gradations is performed with a base current set to 0 and about one quarter of a peak amplitude in the prior art set as a peak amplitude. Gradation representation for 65 to 128 gradations is performed with a current value at a peak in representing 0 to 64 gradations set as a base current and about one quarter of a peak amplitude in the prior art set as a peak amplitude. It is possible to set a width of one bit about four times as large as that in the prior art by converting a base current in this way. It is possible to widen a width of a pulse itself and intervals of pulses and perform accurate and high-speed switching easily in response to an image signal by setting a width of one bit large. Consequently, a light source control device for displaying an image with high resolution and an image with a large number of gradations using accurate gradations easily is obtained.

According to still another aspect of the invention, it is possible to provide a light source control method of controlling driving for a light source unit in order to supply light that is modulated in response to an image signal. The light source control method can include allocating at least one bit of the image signal to conversion of an amplitude of the pulse signal and converting the amplitude of the pulse signal according to an allocated number of bits, and generating a pulse signal at the converted amplitude.

In the invention, a pulse width can be changed in the same manner as the PWM in the prior art. In addition, gradation representation is performed by changing an amplitude of a pulse signal. For example, when gradation representation of eight bits is performed, if high order two bits of an image signal are allocated to the conversion of an amplitude of a pulse signal, the amplitude of the pulse signal is converted in two bits. Considering that strength of light, which eyes of an observer feel, is a product of intensity of the light and a lighting time of the light, it is possible to set the pulse width four times as large as that in the prior art by converting the amplitude of the pulse signal into an amplitude that is one quarter of the amplitude in the prior art. In this way, it is possible to change a width of one bit according to a range of the high order two bits. In particular, it is possible to drive a laser beam source, for which it is difficult to perform high-speed switching, accurately in response to an image signal by increasing a width of one bit in a small gradation. Consequently, it is possible to represent an image with high resolution and an image with a large number of gradations using accurate gradations easily.

According to still another aspect of the invention, it is possible to provide a light source control method of controlling driving for a light source unit in order to supply light that is modulated in response to an image signal. The light source control method can include allocating at least one bit of the image signal to conversion of a current value of a base current and converting the current value of the base current according to an allocated number of bits, and generating a pulse signal with the base current of the converted current value as a reference.

In the invention, other than changing a pulse width in the same manner as the PWM in the prior art, gradation representation is performed by changing a current value of a base current. For example, when gradation representation of eight bits is performed, if high order two bits of an image signal are allocated to the conversion of the base current, the base current is converted in two bits. Other than an original current value of the base current, the base current can be set to current values that are one quarter, one half, and three quarter of an original current amplitude. For example, gradation representation for 0 to 64 gradations is performed with a base current set to 0 and about one quarter of a peak amplitude in the prior art set as a peak amplitude. Gradation representation for 65 to 128 gradations is performed with a current value at a peak in representing 0 to 64 gradations set as a base current and about one quarter of a peak amplitude in the prior art set as a peak amplitude. It is possible to set a width of one bit about four times as large as that in the prior art by converting a base current in this way. Consequently, it is possible to display an image with high resolution and an image with a large number of gradations using accurate gradations easily.

According to still another aspect of the invention, it is possible to provide an image display apparatus that can include a light source unit that supplies light modulated in response to an image signal; a light source control device that controls driving for the light source unit, and a scanning unit that performs a scanning operation for a predetermined surface using light from the light source unit. The light source control device can include an amplitude converting unit that allocates at least one bit of the image signal to conversion of an amplitude of a pulse signal and converts the amplitude of the pulse signal according to an allocated number of bits, and a pulse signal generating unit that generates a pulse signal at the amplitude converted in the amplitude converting unit. Consequently, an image display apparatus capable of displaying an image with high resolution and an image with a large number of gradations using accurate gradations easily can be obtained.

According to still another aspect of the invention, it is possible to provide an image display apparatus that can include a light source unit that supplies light modulated in response to an image signal, a light source control device that controls driving for the light source unit, and a scanning unit that performs a scanning operation for a predetermined surface using light from the light source unit. The light source control device can include a base current converting unit that allocates at least one bit of the image signal to conversion of a current value of a base current and converts the current value of the base current according to an allocated number of bits, and a pulse signal generating unit that generates a pulse signal with the base current of the current value converted in the base current converting unit as a reference. Consequently, an image display apparatus capable of displaying an image with high resolution and an image with a large number of gradations using accurate gradations easily is obtained.

BRIEF DESCRIPTION OF THE DRAWINGS

The invention will be described with reference to the accompanying drawings, wherein like numbers reference like elements, and wherein:

FIG. 6A is a diagram for explaining generation of an amplitude control signal and generation of a pulse width control signal;

FIG. 6B is a diagram for explaining generation of an amplitude control signal and generation of a pulse width control signal;

FIG. 6C is a diagram for explaining generation of an amplitude control signal and generation of a pulse width control signal;

DETAILED DESCRIPTION OF EMBODIMENTS

Exemplary embodiments of the invention will be hereinafter explained in detail with reference to the accompanying drawings.

Figure 1:
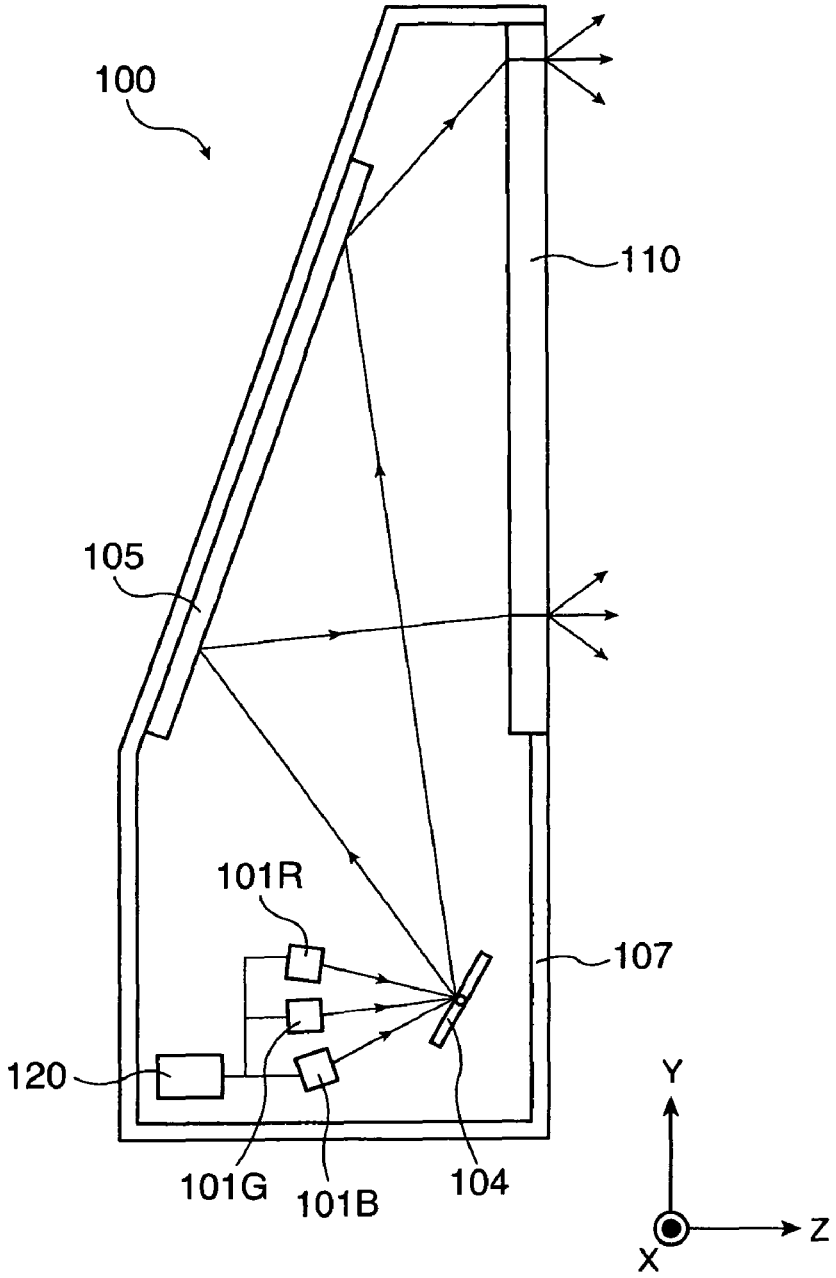
FIG. 1 is a schematic diagram of an image display apparatus according to a first exemplary embodiment of the invention.

FIG. 1 shows a schematic structure of an image display apparatus 100 according to a first exemplary embodiment of the invention. The image display apparatus 100 is a so-called rear projector that supplies a laser beam to one surface of a screen 110. An observer observes light emitted from the other surface of the screen 110 to enjoy an image. The image display apparatus 100 displays an image on a surface of the screen 110, which is a predetermined surface, using light from light source units 101R, 101G, and 101B.

A light source control device 120 controls driving for the light source units 101R, 101G, and 101B. The light source units 101R, 101G, and 101B supply a red laser beam, a green laser beam, and a blue laser beam, which are modulated in response to an image signal, according to control of the light source control device 120, respectively. As the light source units 101R, 101G, and 101B, a semiconductor laser or a solid state laser can be used. Note that a shaping optical system, which shapes a laser beam into a beam shape with a diameter of, for example, 0.5 mm, may be provided on exit sides of the light source units 101R, 101G, and 101B.

The laser beams from the light source units 101R, 101G, and 101B are reflected on a galvanometer mirror 104 and, then, made incident on a reflecting mirror 105. The galvanometer mirror 104 is a scanning unit that performs a scanning operation on the screen 110 using laser beams from the respective light source units 101R, 101G, and 101B. The respective laser beams from the light source units 101R, 101G, and 101B are used for scanning operations in an X direction, which is a first direction, and a Y direction, which is a second direction, substantially orthogonal to the first direction on the screen 110.

The galvanometer mirror 104 drives the reflecting mirror to rotationally move in a two-dimensional direction of a horizontal direction and a vertical direction. The galvanometer mirror 104 can be manufactured by, for example, the micro electro mechanical systems (MEMS) technique. The laser beams reflected on the galvanometer mirror 104 are made incident on the reflecting mirror 105. The reflecting mirror 105 is provided in a position opposed to the screen 110 on an inner surface of a housing 107. The laser beams made incident on the reflecting mirror 105 travel in a direction of the screen 110. The housing 107 seals a space inside the housing 107.

The screen 110 is provided over a predetermined surface of the housing 107. The screen 110 is a transmission screen that transmits a laser beam modulated in response to an image signal. Light from the reflection mirror 105 is made incident on the screen 110 from a surface thereof on an inner side of the housing 107 and, then, exits from a surface on an observer side. The observer observes the light exiting from the screen 110 to enjoy an image.

Figure 2:
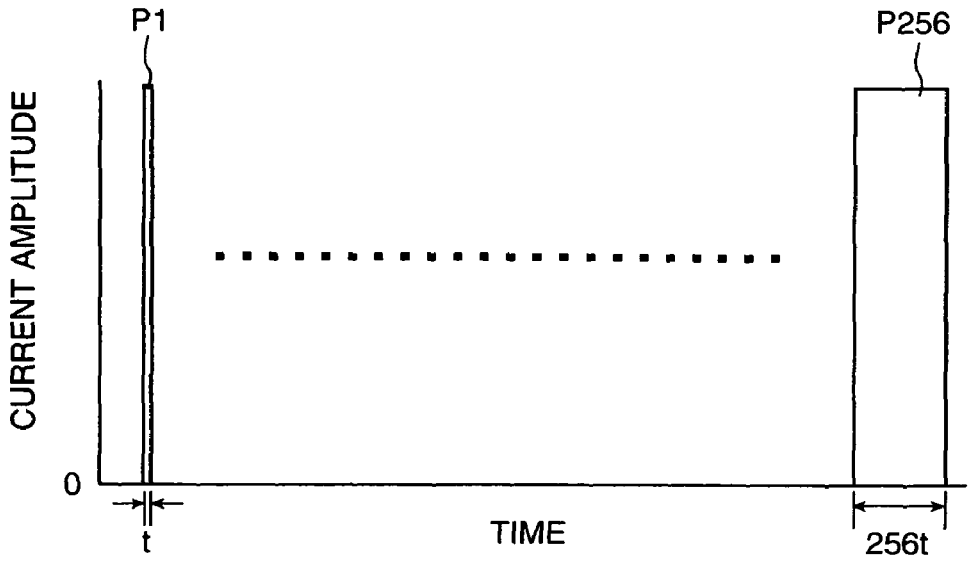
FIG. 2 is a graph for explaining control for a laser beam in the prior art.

FIG. 2 is a graph for explaining, as comparison with the invention, control for a laser beam in the prior art at the time when an image is displayed in eight bits. When the PWM in the prior art is used, pulses from a pulse P1 representing one gradation to a pulse P256 representing 256 gradations are set with a minimum pulse width t as a unit. The pulse width t of the pulse P1 is 1/256 of a pulse width of the maximum pulse P256. For example, when an image made of vertical 1080 pixels and horizontal 1920 pixels is displayed with one frame set as 60 hertz, it is necessary to set t to an extremely small value 1/60'1080'1920'256 (seconds). As the number of pixels of the image can be increased and as the number of gradations of the image is increased, the minimum unit t of the pulse is reduced. It is extremely difficult to switch a high-power laser beam source accurately and at high speed according to a pulse of a small width.

Figure 3:
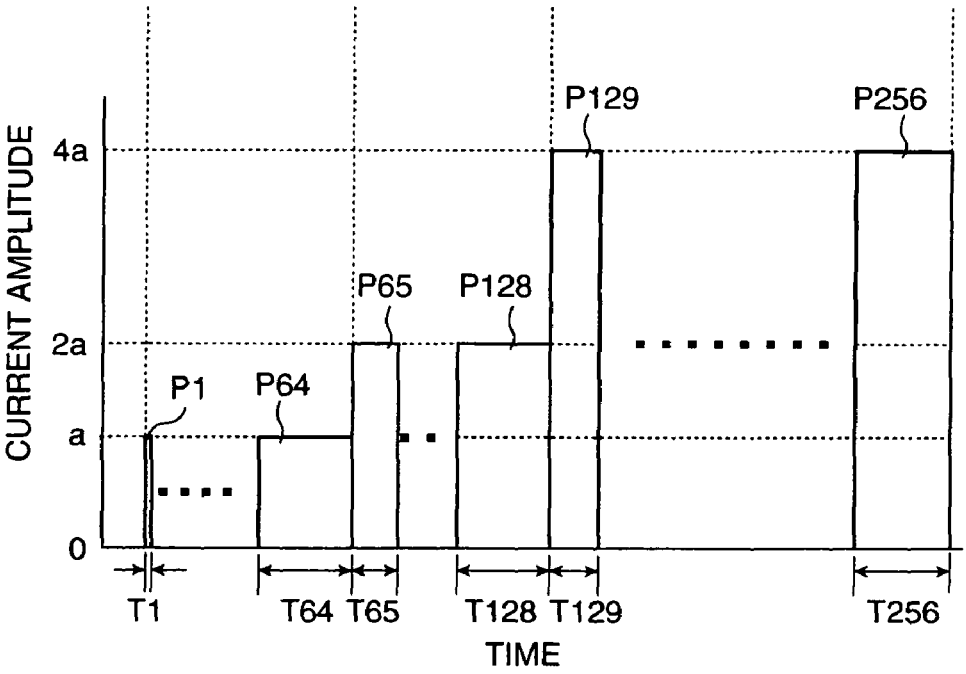
FIG. 3 is a graph for explaining control by a light source control device.

FIG. 3 is a graph for explaining control by the light source control device 120 at the time when an image is displayed in eight bits by the image display apparatus 100. From a pulse P1 representing one gradation to a pulse P64 representing 64 gradations, a current amplitude is set to "a" that is about one quarter of an original amplitude. Considering that strength of light, which eyes of an observer feel, is a product of intensity of the light and a lighting time of the light, it is possible to set a pulse width T1 of the pulse P1, which is a minimum unit, about four times as large as the pulse width t of a minimum unit by setting the current amplitude "a" to one quarter of the original amplitude. In addition, the pulse width T64 of the pulse P64 is also about four times as large as the pulse width in the prior art. From the pulse P1 to the pulse P64, pulses are timed with the pulse width T1, which is about four times as large as the pulse width t, as a unit. Since a pulse width is set to about four times as large as the original pulse width and a current amplitude is set to about one quarter of the original current amplitude, the observer observes light in the same manner as in the prior art. Even if it is difficult to switch a laser beam source at high speed, it is possible to perform switching accurately according to a pulse by widening a width of the pulses P1 to P64 to about four times as large as the original width.

From a pulse P65 representing 65 gradations to a pulse P128 representing 128 gradations, a current amplitude is set to 2*a* that is about one half of the original amplitude. It is possible to set a pulse width T65 of the pulse P65 to about twice as large as the pulse width in the prior art by setting the current amplitude 2*a* to one half of the original amplitude. In addition, a pulse width T128 of the pulse P128 is also about twice as large as the pulse width in the prior art. From the pulse P65 to the pulse P128, pulses are timed with a pulse width T1/2, which is about twice as large as the pulse width t, as a unit. Since a pulse width is set to about twice as large as the original pulse width and a current amplitude is set to about one half of the original current amplitude, the observer observes light in the same manner as in the prior art.

From a pulse P129 representing 129 gradations to a pulse P256 representing 256 gradations, a current amplitude is set to 4*a* that is substantially identical with the original amplitude. Since the current amplitude 4*a* is set to the amplitude substantially identical with the original amplitude, a pulse width T129 of the pulse P129 is substantially identical with the pulse width in the prior art. In addition, a pulse width T256 of the pulse P256 is substantially identical with the pulse width in the prior art. From the pulse P129 to the pulse P256, pulses are timed with the same pulse width as in the prior art as a unit. Since a current amplitude and a pulse width are the same as those in the prior art, the observer observes light in the same manner as in the prior art.

Figure 4:
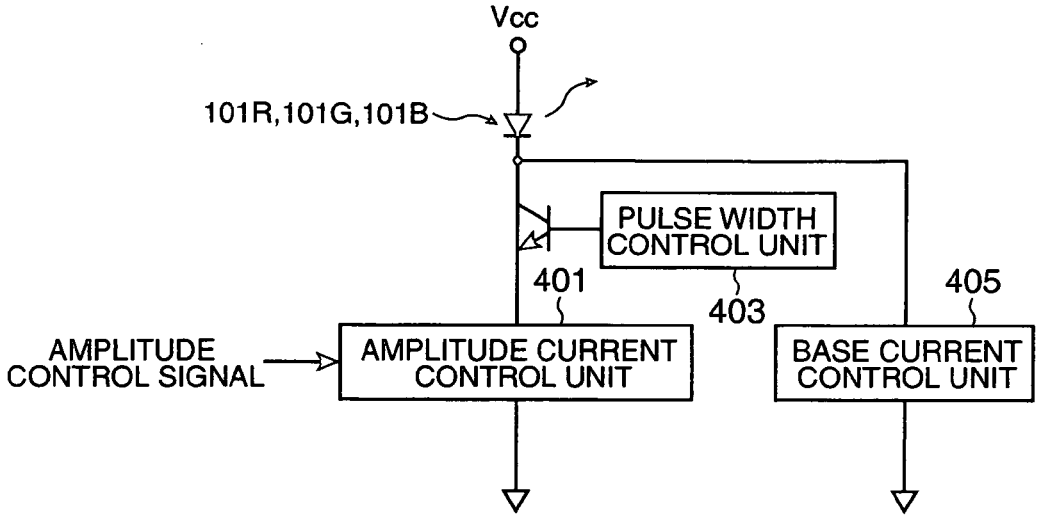
FIG. 4 is a diagram for explaining a structure for driving a light source unit.

FIG. 4 is a diagram for explaining an exemplary structure for driving the light source units 101R, 101G, and 101B. Driving for the light source units 101R, 101G, and 101B is controlled by an amplitude current control unit 401, a base current control unit 405, and a pulse width control unit 403. The base current control unit 405 controls a base current. In this exemplary embodiment, the base current control unit 405 controls a base current such that the light source units 101R, 101G, and 101B use a substantially constant current value as the base current. The amplitude current control unit 401 converts an amplitude in response to an amplitude control signal. The pulse width control unit 403 controls a pulse width in response to a pulse width control signal based on an image signal.

Figure 5:
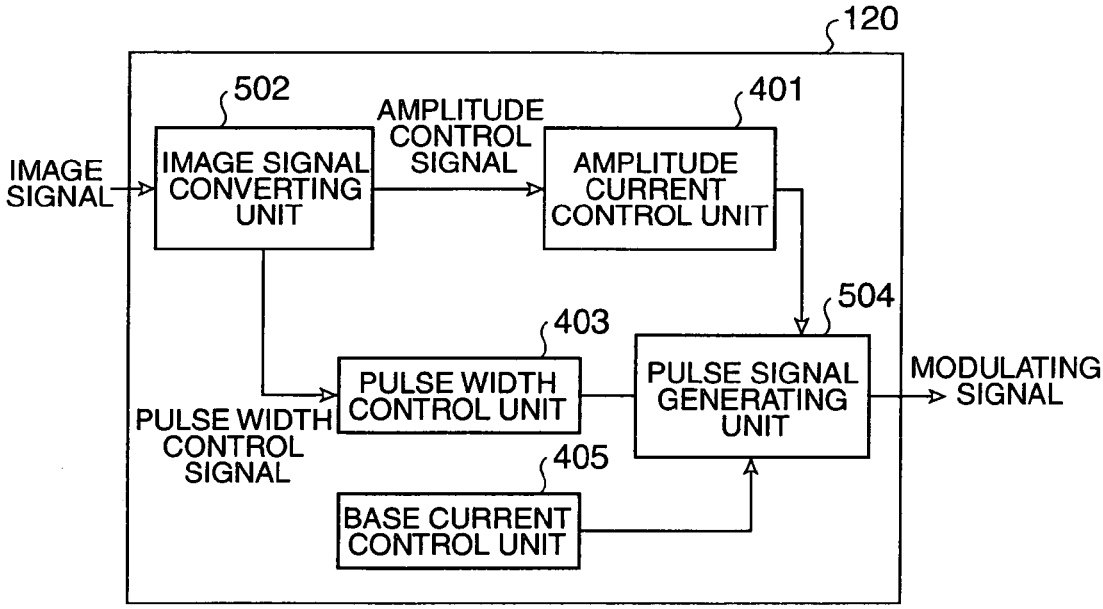
FIG. 5 is a diagram for explaining a structure of the light source control device.

FIG. 5 is a diagram for explaining a structure of the light source control device 120. An image signal inputted to the light source control device 120 is converted into an amplitude control signal and a pulse width control signal by an image signal converting unit 502. The image signal converting unit 502 outputs high order two bits of eight bits of the image signal to the amplitude current control unit 401 as an amplitude control signal. In addition, the image signal converting unit 502 converts eight bits of the image signal into a pulse width control signal and outputs the pulse width control signal to the pulse width control unit 403.

FIGS. 6A to 6C are diagrams for explaining generation of an amplitude control signal and generation of a pulse width control signal based on an image signal. As shown in FIG. 6A, when an 8-bit image signal SD1, high order two bits D6 and D7 of which are 0 and 0, is inputted to the image signal converting unit 502, the image signal converting unit 502 outputs an amplitude control signal for converting a current amplitude into "a" to the amplitude current control unit 401. In addition, the image signal converting unit 502 adds two bits on a low order side of 6 bits D0 to D5 of the image signal SD1 and puts 0 and 0 in the added two bits. The image signal converting unit 502 outputs a new 8-bit signal SN1 formed in this way to the pulse width control unit 403 as a pulse width control signal. In this way, the image signal converting unit 502 generates a pulse width control signal timed with the pulse width T1 that is about four times as large as the original pulse width t.

As shown in FIG. 6B, when an image signal SD2, high order two bits D6 and D7 of which are 1 and 0, is inputted to the image signal converting unit 502, the image signal converting unit 502 outputs an amplitude conversion signal for converting a current amplitude into 2*a* to the amplitude current control unit 401. In addition, the image signal converting unit 502 adds one bit on a low order side of 7 bits D0 to D6 of the image signal SD2 and puts 0 in the added one bit. The image signal converting unit 502 outputs a new 8-bit signal SN2 formed in this way to the pulse width control unit 403 as a pulse width control signal. In this way, the image signal converting unit 502 generates a pulse width control signal timed with the pulse width T1/2 that is about twice as large as the original pulse width t.

As shown in FIG. 6C, when an image signal SD3, high order two bits D6 and D7 of which are 0 and 1 or 1 and 1, is inputted to the image signal converting unit 502, the image signal converting unit 502 outputs an amplitude conversion signal for converting a current amplitude into 4*a* to the amplitude current control unit 401. In addition, the image signal converting unit 502 sets eight bits D0 to D7 of the image signal SD3 as a new 8-bit signal SN3 directly and outputs the signal SN3 to the pulse width control unit 403 as a pulse width control signal. In this way, the image signal converting unit 502 generates a pulse width control signal timed with the pulse width t that is identical with the original pulse width t.

Referring back to FIG. 5, the amplitude current control unit 401 converts a current amplitude of a pulse signal in response to the amplitude control signal from the image signal converting unit 502. Therefore, the image signal converting unit 502 and the amplitude current control unit 401 are amplitude converting units that allocate two bits of an image signal to conversion of an amplitude of a pulse signal and convert the amplitude of the pulse signal according to an allocated number of bits. The pulse width control unit 403 controls a pulse width of the pulse signal in response to pulse width control signals SN1, SN2, and SN3 from the image signal converting unit 502. The base current control unit 405 sets a substantially constant current value as a base current. A pulse signal generating unit 504 generates a pulse signal according to outputs of the amplitude current control unit 401, the pulse width control unit 403, and the base current control unit 405. In this way, the pulse signal generating unit 504 generates a pulse signal with an amplitude, which is converted in the image signal converting unit 502 and the amplitude current control unit 401 serving as amplitude converting units, as a reference.

The light source control device 120 can change a width of one bit according to a range of high order two bits as described above. In particular, by setting a width of one bit in a small gradation large, it is possible to drive a laser beam source, for which it is difficult to perform high-speed switching, accurately in response to an image signal. Consequently, there can be an advantage that it is possible to display an image with high resolution and an image with a large number of gradations using accurate gradations easily.

Note that, in this exemplary embodiment, high order two bits of eight bits are allocated to convert an amplitude of a pulse signal. However, it should be understood that the light source control device 120 is not limited to allocation of high order two bits for conversion of an amplitude of a pulse signal. If the light source control device 120 allocates at least one bit of an image signal to conversion of an amplitude of a pulse signal, there is an advantage that it is possible to control the light source units 101R, 101G, and 101B accurately in response to the image signal even if high-speed switching is difficult.

Figure 7:
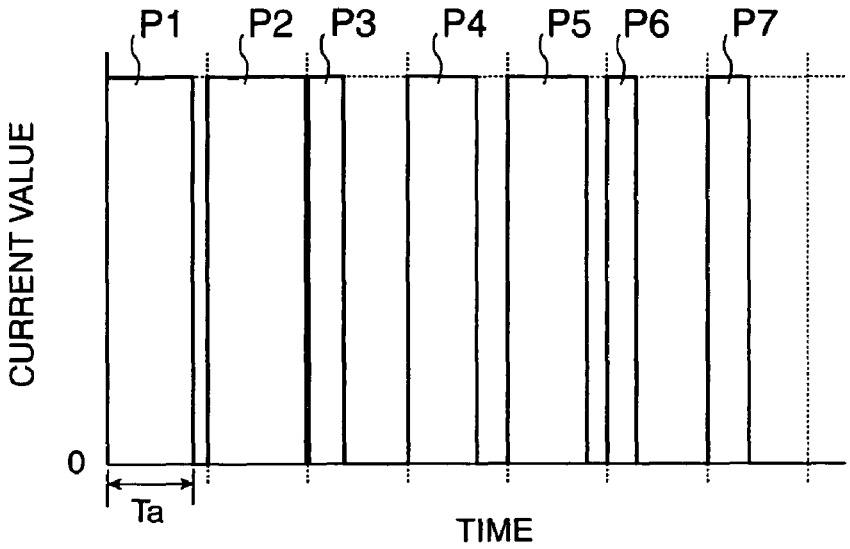
FIG. 7 is a graph for explaining control for a laser beam in the prior art.
Figure 8:
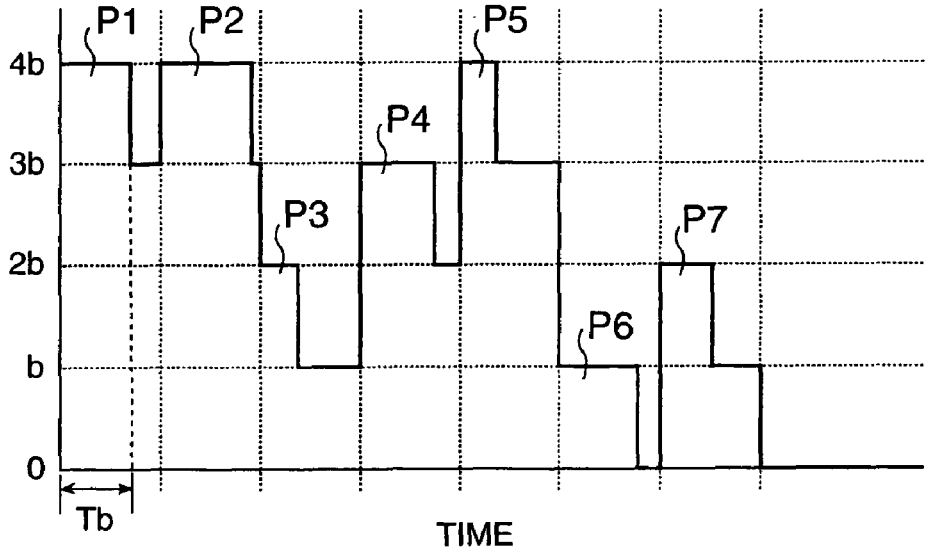
FIG. 8 is a graph for explaining control by a light source control device according to a second exemplary embodiment of the invention.

FIGS. 7 and 8 are graphs for explaining control of a light source unit by a light source control device according to a second embodiment of the invention. It is possible to apply the light source control device in this embodiment to the image display apparatus 100 in the first exemplary embodiment. Components identical with those of the image display apparatus 100 in the first exemplary embodiment are denoted by the identical reference numerals and signs and repeated explanations are omitted. The light source control device in this exemplary embodiment is characterized in that two bits of eight bits of an image signal are allocated to conversion of a base current and a current value of the base current is converted according to an allocated number of bits.

FIG. 7 is a graph for explaining control for a laser beam in the prior art at the time when an image is displayed with eight bits in comparison with the invention. FIG. 7 shows an example of a pulse signal corresponding to an image signal. When the PWM in the prior art is used, pulse widths of pulses P1 to P7 are determined with a pulse width t, which is obtained by dividing a one frame period into 256 pieces, as a unit. Therefore, it is conceivable that, depending on an image signal, there is a pulse with an extremely small width and there is an extremely small interval between pulses. It is extremely difficult to perform switching accurately and at high speed for a high-power laser beam source according to a pulse with a particularly small width and pulses arranged at small intervals.

FIG. 8 is a graph for explaining control by the light source control device in this exemplary embodiment. FIG. 8 shows a pulse signal based on an image signal that is identical with the pulse signal shown in FIG. 7. When a base current, at which supply of a laser beam is originally zero, is set as a current value 0, the light source control device in this exemplary embodiment converts a current value of the base current in four stages 0, b, 2*b*, and 3*b* according to two bits of eight bits. The current values b, 2*b*, and 3*b* set anew as base currents are equivalent to current values that are one quarter, one half, and three quarter of the original current amplitude 4*b*, respectively. Here, the current value 0 of the original base current means a bias current equivalent to a current value on a bottom side in the original current amplitude.

In pulse P1, the current value of the base current is set to 3*b*. 192 gradations of gradations represented by the pulse P1 are covered by supply of laser beams according to the base current of the current value 3*b*. The remaining gradations represented by the pulse P1 are covered by a new pulse P1 with the amplitude b based on the base current 3*b*. The new pulse P1 set in this way has a pulse width Tb smaller than a pulse width Ta of the pulse P1 shown in FIG. 7. Since the pulse width of the pulse P1 is reduced from Ta to Tb, it is possible to widen an interval between the pulse P1 and the pulse P2. Even if it is difficult to perform high-speed switching for the laser beam source, it is possible to perform switching accurately according to a pulse by widening the interval between the pulse P1 and the pulse P2.

The current value of the base current is still set to 3*b* for the pulse P2 as in the pulse P1. In the pulse P3, the current value of the base current is converted into b. The pulse P3 changes to a new pulse P3 with an amplitude b based on the base current b. Thereafter, in the pulses P4, P5 P6, and P7, the current values of the base currents are converted into 2*b*, 3*b*, 0, and b, respectively. Considering that strength of light, which eyes of an observer feel, is a product of intensity of the light and a lighting time of the light, by setting an amplitude to about one quarter of that in the prior art, the new pulses P1 to P7 time pulses with a pulse width, that is about four times as large as the unit pulse width t in the prior art, as a unit. Since the current value of the base current is converted in four stages and the current amplitude is set to about one quarter of the original current amplitude, the observer observes light as in the prior art.

Figure 9:
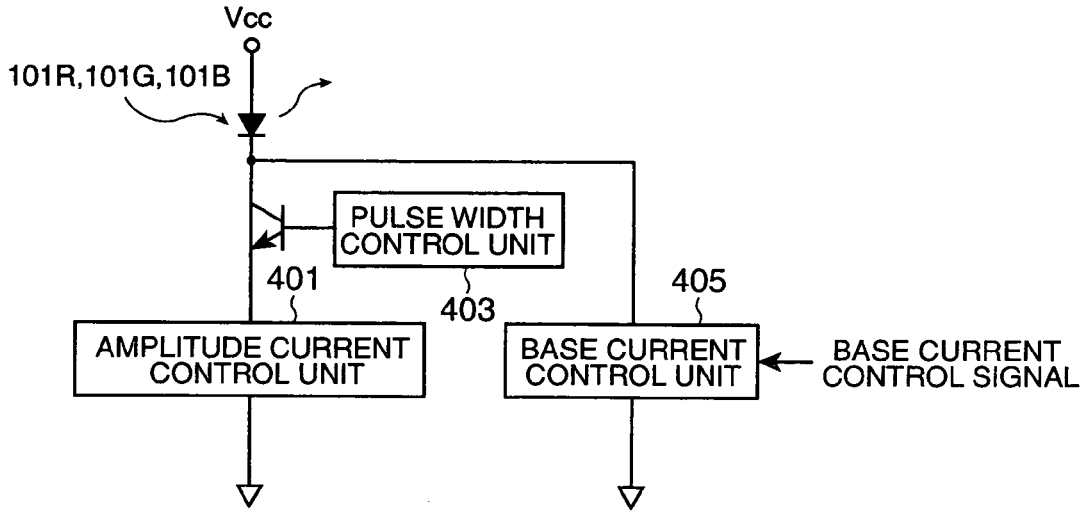
FIG. 9 is a diagram for explaining a structure for driving a light source unit.

FIG. 9 is a diagram for explaining an exemplary structure for driving the light source units 101R, 101G, and 101B. The amplitude current control unit 401 controls a current amplitude. In this exemplary embodiment, the amplitude current control unit 401 controls a current amplitude such that a pulse has a constant current amplitude b. The base current control unit 405 converts a current value of a base current in response to a base current control signal. The pulse width control unit 403 controls a pulse width in response to a pulse width control signal based on an image signal.

Figure 10:
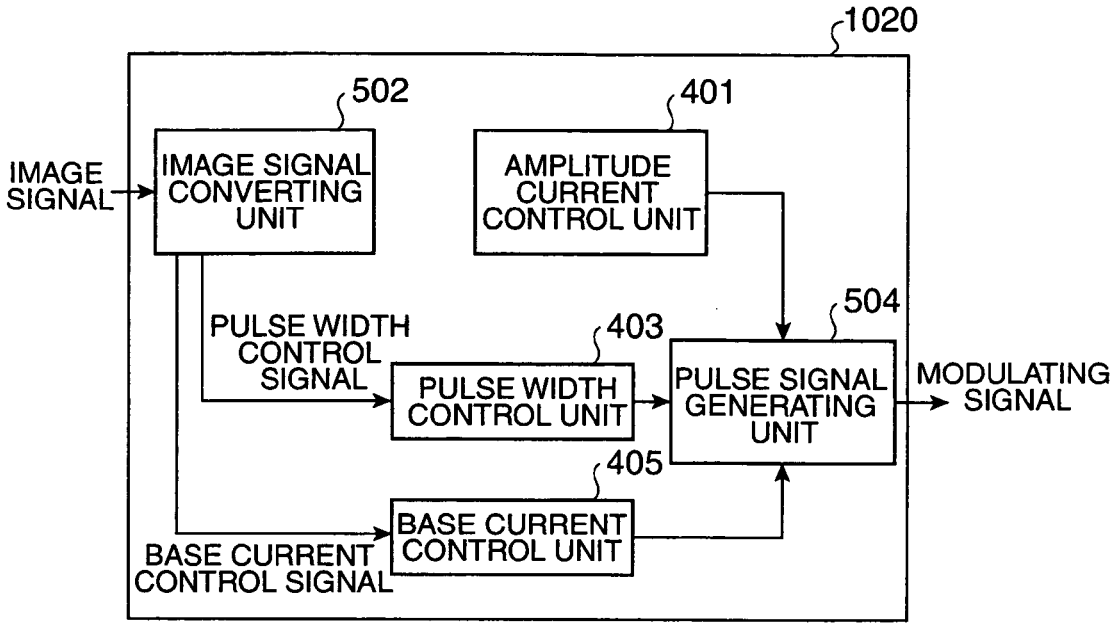
FIG. 10 is a diagram for explaining a structure of the light source control device.

FIG. 10 is a diagram for explaining an exemplary structure of a light source control device 1020 in this exemplary embodiment. An image signal inputted to the light source control device 1020 is converted into a base current control signal and a pulse width control signal in the image signal converting unit 502. The image signal converting unit 502 outputs high order two bits of eight bits of the image signal to the base current control unit 405 as a base current control signal. In addition, the image signal converting unit 502 extracts low order 6 bits of eight bits of the image signal and outputs the low order 6 bits to the pulse width control unit 403 as a pulse width control signal.

Figure 11:
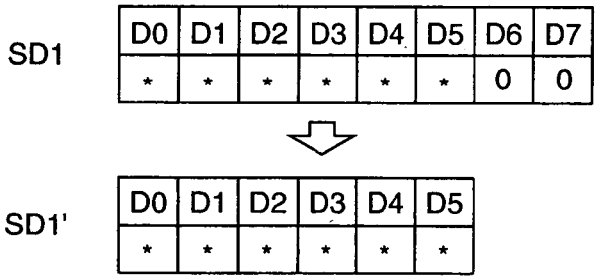
FIG. 11 is a diagram for explaining generation of a base current control signal and generation of a pulse width control signal.

FIG. 11 is a diagram for explaining generation of a base current control signal and generation of a pulse width control signal based on an image signal. When 0 to 64 gradations are displayed, an 8-bit image signal, high order two bits D6 and D7 of which are 0 and 0, is generated. When an 8-bit image signal SD1, high order two bits D6 and D7 of which are 0 and 0, is inputted to the image signal converting unit 502, the image signal converting unit 502 outputs a base current control signal for converting a current value of a base current into 0 to the base current control unit 405. In addition, the image signal converting unit 502 extracts low order 6 bits D0 to D5 of the image signal SD1. The image signal converting unit 502 outputs a new 6-bit signal SD1' formed in this way to the pulse width control unit 403 as a pulse width control signal. In this way, the image signal converting unit 502 generates a pulse width control signal timed with a pulse width that is about four times as large as the original pulse width t.

When 65 to 128 gradations are displayed, an 8-bit image signal, high order two bits of which are 0 and 1, is generated. When the 8-bit image signal, high order two bits of which are 0 and 1, is inputted to the image signal converting unit 502, the image signal converting unit 502 outputs a base current control signal for converting a current value of a base current into b to the base current control unit 405. When 129 to 192 gradations are displayed, an 8-bit image signal, high order two bits of which are 1 and 0, is generated. When the 8-bit image signal, high order two bits of which are 1 and 0, is inputted to the image signal converting unit 502, the image signal converting unit 502 outputs a base current control signal for converting a current value of a base current into 2*b* to the base current control unit 405.

When 193 to 256 gradations are displayed, an 8-bit image signal, high order two bits of which are 1 and 1, is generated. When the 8-bit image signal, high order two bits of which are 1 and 1, is inputted to the image signal converting unit 502, the image signal converting unit 502 outputs a base current control signal for converting a current value of a base current into 3*b* to the base current control unit 405. When the high order two bits are 0 and 1, 1 and 0, and 1 and 1, a pulse width control signal is generated in the same manner as at the time when the high order two bits are 0 and 0.

Referring back to FIG. 10, the base current control unit 405 can convert a base current in response to the base current control signal from the image signal converting unit 502. Therefore, the image signal converting unit 502 and the base current control unit 405 are base current converting units that allocate two bits of an image signal to conversion of a current value of a base current and convert the current value of the base current according to an allocated number of bits. The pulse width control unit 403 controls a pulse width of a pulse signal in response to a pulse width control signal from the image signal converting unit 502. The amplitude current control unit 401 sets a current amplitude to a constant current value b. A pulse signal generating unit 504 generates a pulse signal according to outputs of the base current control unit 405, the pulse width control unit 403, and the amplitude current control unit 401. In this way, the pulse signal generating unit 504 generates a pulse signal with the base current of the current value, which is converted in the image signal converting unit 502 and the base current control unit 405 serving as base current converting units, as a reference.

The light source control device 1020 converts a current value of a base current according to a range of high order two bits as described above. It is possible to set a width of one bit about four times as large as the width in the prior art by converting the current value of the base current. By setting the width of one bit large, it is possible to widen a width of a pulse itself and an interval between pulses and perform accurate and high-speed switching easily in response to an image signal. Consequently, there is an advantage that it is possible to display an image with high resolution and an image with a large number of gradations using accurate gradations easily. In this exemplary embodiment, again, it should be understood that the light source control device 1020 is not limited to allocation of high order two bits of eight bits to conversion of a current value of a base current. If the light source control device 1020 allocates at least one bit of an image signal to conversion of a current value of a base current, there is an advantage that it is possible to control the light source units 101R, 101G, and 101B accurately in response to the image signal even if high-speed switching is difficult.

Figure 12:
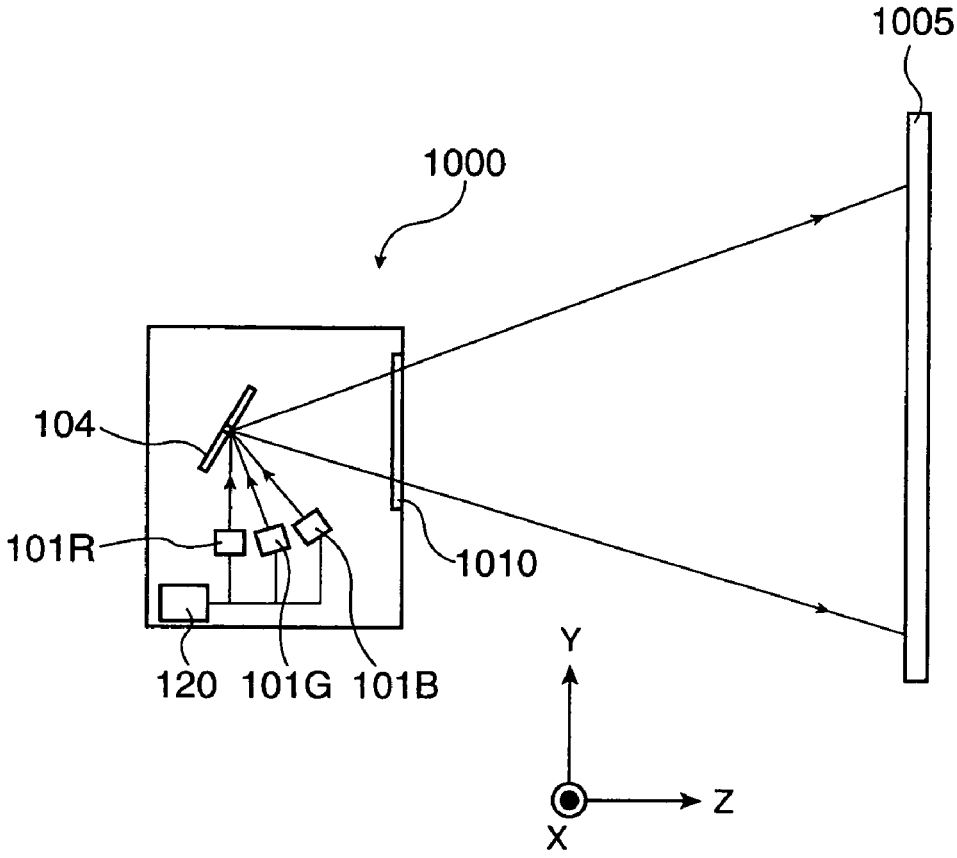
FIG. 12 is a schematic diagram of an image display apparatus according to a third exemplary embodiment of the invention.

FIG. 12 shows a schematic structure of an image display apparatus 1000 according to a third exemplary embodiment of the invention. Components identical with those in the first exemplary embodiment are denoted by the identical reference numerals and signs and repeated explanations are omitted. The image display apparatus 1000 is a so-called front projector that supplies a laser beam to a screen 1005 provided on an observer side. The observer observes light reflected on the screen 1005 to enjoy an image.

An exit window 1010 made of a transparent member such as glass and transparent resin is provided on a surface on the observer side of the image display apparatus 1000. A laser beam from the galvanometer mirror 104 is transmitted through the exit window 1010 and, then, made incident on the screen 1005. The image display apparatus 1000 displays an image on a surface of the screen 1005, which is a predetermined screen, according to light from the light source units 101R, 101G, and 101B. In this embodiment, it is also possible to display an image with high resolution and an image with a large number of gradations using accurate gradations easily by using the light source control device 120 in the image display apparatus 1000.

It should be noted that the scanning unit is not limited to the galvanometer mirror 104 in which a reflecting mirror driven in a two-dimensional direction is provided. For example, a reflecting mirror, which moves rotationally in one predetermined direction, and a reflecting mirror, which moves rotationally in a direction substantially orthogonal to the predetermined one direction, may be used in combination. In the embodiments described above, the light source units for supplying laser beams are used. However, any light source units may be used as long as the light source units are capable of supplying beam-like light. For example, solid state light-emitting elements such as a light-emitting diode element (LED) may be used as the light source units.

As described above, the light source control device according to the invention is suitable for displaying an image with high resolution and an image with a large number of gradations.

While this invention has been described in conjunction with specific embodiments thereof, it is evident that many alternatives, modifications and variations will be apparent to those skilled in the art. Accordingly, preferred embodiments of the invention as set forth herein are intended to be illustrative, not limiting. There are changes that may be made without departing from the spirit and scope of the invention.

What is claimed is:

1. A light source control device that controls driving for a solid state light-emitting element provided in a light source unit in order to supply light that is modulated in response to an image signal, the light source control device comprising:

an image signal converting unit that generates and outputs an amplitude control signal and a pulse width control signal based on the image signal;

an amplitude current control unit that converts an amplitude current of a pulse signal according to the amplitude control signal;

a pulse width control unit that controls a pulse width of the pulse signal according to the pulse width control signal; and a pulse signal generating unit that generates the pulse signal based on an output from the amplitude current control unit and an output from the pulse width control unit, the pulse signal having varying current amplitude, wherein the image signal is composed of N bit data, the amplitude control signal is generated according to M bit data of the N bit data of the image signal, M is equal or greater than 1 and less than N, the pulse width control signal is generated by shifting L bit data of the N bit data of the image signal by zero and more bits according to the value of the M bit data, wherein the N bit data of the image signal excluding the M bit data corresponds to the L bit data, and the pulse width control signal is generated so that a first unit is longer than a second unit, wherein the first unit is a unit of the pulse width of the pulse signal according to the variation of the L bit data of the image signal when the amplitude of the pulse signal converted according to the amplitude control signal is a first amplitude, the second unit is a unit of the pulse width of the pulse signal according to the variation of the L bit data of the image signal when the amplitude of the pulse signal converted according to the amplitude control signal is a second amplitude, and the first amplitude is smaller than the second amplitude.

2. A light source control device that controls driving for a solid state light-emitting element provided in a light source unit in order to supply light that is modulated in response to an image signal, the light source control device comprising:

an image signal converting unit that generates and outputs a base current control signal and a pulse width control signal based on the image signal;

a base current converting unit that converts an amplitude current of a base current according to the base current control signal;

a pulse width control unit that controls a pulse width of the pulse signal according to the pulse width control signal; and a pulse signal generating unit that generates the pulse signal based on an output from the base current converting unit and an output from the pulse width control unit, the pulse signal having varying current amplitude, wherein the image signal is composed of N bit data, the amplitude control signal is generated according to M bit data of the N bit data of the image signal, M is equal to or greater than 1 and less than N, and the pulse width control signal is generated by shifting L bit data of the N bit data of the image signal by zero and more bits according to the value of the M bit data, wherein the N bit data of the image signal excluding the M bit data corresponds to the L bit data.

3. A light source control method of controlling driving for a solid state light-emitting element provided in a light source unit in order to supply light that is modulated in response to an image signal, the light source control method comprising:

generating an amplitude control signal and a pulse width control signal based on the image signal;

outputting, from an image signal converting unit, the amplitude control signal and the pulse width control signal;

converting, by an amplitude current control unit, an amplitude current of a pulse signal according to the amplitude control signal;

controlling, by a pulse width control unit, a pulse width of the pulse signal according to the pulse width control signal; and generating, by a pulse signal generating unit, the pulse signal based on an output from the amplitude current control unit and an output from the pulse width control unit, the pulse signal having varying current amplitude, wherein the image signal is composed of N bit data, the amplitude control signal is generated according to M bit data of the N bit data of the image signal, M is equal or greater than 1 and less than N, the pulse width control signal is generated by shifting L bit data of the N bit data of the image signal by zero and more bits according to the value of the M bit data, wherein the N bit data of the image signal excluding the M bit data corresponds to the L bit data, and the pulse width control signal is generated so that a first unit is longer than a second unit, wherein the first unit is a unit of the pulse width of the pulse signal according to the variation of the L bit data of the image signal when the amplitude of the pulse signal converted according to the amplitude control signal is a first amplitude, the second unit is a unit of the pulse width of the pulse signal according to the variation of the L bit data of the image signal when the amplitude of the pulse signal converted according to the amplitude control signal is a second amplitude, and the first amplitude is smaller than the second amplitude.

4. A light source control method of controlling driving for a solid state light-emitting element provided in a light source unit in order to supply light that is modulated in response to an image signal, the light source control method comprising:

generating a base current control signal and a pulse width control signal based on the image signal;

outputting, from an image signal converting unit, the base current control signal and the pulse width control signal;

converting, by a base current converting unit, an amplitude current of a base current according to the base current control signal;

controlling, by a pulse width control unit, a pulse width of the pulse signal according to the pulse width control signal; and generating, by a pulse signal generating unit, the pulse signal based on an output from the base current converting unit and an output from the pulse width control unit, the pulse signal having varying current amplitude, wherein the image signal is composed of N bit data, the amplitude control signal is generated according to M bit data of the N bit data of the image signal, M is equal or greater than 1 and less than N, and the pulse width control signal is generated by shifting L bit data of the N bit data of the image signal by zero and more bits according to the value of the M bit data, wherein the N bit data of the image signal excluding the M bit data corresponds to the L bit data.

5. An image display apparatus, comprising:

a light source unit that supplies light modulated in response to an image signal;

a light source control device that controls driving for a solid state light-emitting element provided in the light source unit;

a scanning unit that performs a scanning operation for a predetermined surface using light from the light source unit;

the light source control device including:

an image signal converting unit that generates and outputs an amplitude control signal and a pulse width control signal based on the image signal;

an amplitude current control unit that converts an amplitude current of a pulse signal according to the amplitude control signal;

a pulse width control unit that controls a pulse width of the pulse signal according to the pulse width control signal; and a pulse signal generating unit that generates the pulse signal based on an output from the amplitude current control unit and an output from the pulse width control unit, the pulse signal having varying current amplitude, wherein the image signal is composed of N bit data, the amplitude control signal is generated according to M bit data of the N bit data of the image signal, M is equal or greater than 1 and less than N, the pulse width control signal is generated by shifting L bit data of the N bit data of the image signal by zero and more bits according to the value of the M bit data, wherein the N bit data of the image signal excluding the M bit data corresponds to the L bit data, and the pulse width control signal is generated so that a first unit is longer than a second unit, wherein the first unit is a unit of the pulse width of the pulse signal according to the variation of the L bit data of the image signal when the amplitude of the pulse signal converted according to the amplitude control signal is a first amplitude, the second unit is a unit of the pulse width of the pulse signal according to the variation of the L bit data of the image signal when the amplitude of the pulse signal converted according to the amplitude control signal is a second amplitude, and the first amplitude is smaller than the second amplitude.

6. An image display apparatus, comprising:

a light source unit that supplies light modulated in response to an image signal;

a light source control device that controls driving for a solid state light-emitting element provided in the light source unit;

a scanning unit that performs a scanning operation for a predetermined surface using light from the light source unit;

the light source control device includes:

an image signal converting unit that generates and outputs a base current control signal and a pulse width control signal based on the image signal;

a base current converting unit that converts an amplitude current of a base current according to the base current control signal;

a pulse width control unit that controls a pulse width of the pulse signal according to the pulse width control signal; and a pulse signal generating unit that generates the pulse signal based on an output from the base current converting unit and an output from the pulse width control unit, the pulse signal having varying current amplitude, wherein the image signal is composed of N bit data, the amplitude control signal is generated according to M bit data of the N bit data of the image signal, M is equal or greater than 1 and less than N, and the pulse width control signal is generated by shifting L bit data of the N bit data of the image signal by zero and more bits according to the value of the M bit data, wherein the N bit data of the image signal excluding the M bit data corresponds to the L bit data.

7. The light source control device according to claim 1, further comprising:

a base control unit that outputs a base current of the pulse signal, the base current having varying amplitude, wherein the pulse signal generating unit generates the pulse signal also based on the base current output from the base control unit.

8. The light source control device according to claim 2, the base current having varying amplitude, wherein the pulse signal generating unit generates the pulse signal also based on the base current output from the base current converting unit.

* * * * *